US009097500B1

(12) United States Patent
Addleman

(10) Patent No.: US 9,097,500 B1
(45) Date of Patent: Aug. 4, 2015

(54) MODULAR ADJUSTABLE WEIGHT ARROW TIP

(71) Applicant: Thomas Andrew Addleman, Harrisonville, MO (US)

(72) Inventor: Thomas Andrew Addleman, Harrisonville, MO (US)

( * ) Notice: Subject to any disclaimer, the term of this patent is extended or adjusted under 35 U.S.C. 154(b) by 0 days.

(21) Appl. No.: 14/170,815

(22) Filed: Feb. 3, 2014

(51) Int. Cl.
*F42B 6/08* (2006.01)
*F42B 10/00* (2006.01)

(52) U.S. Cl.
CPC .. *F42B 6/08* (2013.01); *F42B 10/00* (2013.01)

(58) Field of Classification Search
USPC ..... 473/578, 582, 583
See application file for complete search history.

(56) References Cited

U.S. PATENT DOCUMENTS

| | | | | |
|---|---|---|---|---|
| 4,254,958 | A | 3/1981 | Bateman, III | |
| 4,621,817 | A * | 11/1986 | Musacchia | 473/583 |
| 5,269,534 | A | 12/1993 | Saunders et al. | |
| 7,318,783 | B2 | 1/2008 | Polando | |
| 8,016,703 | B1 * | 9/2011 | Kronengold et al. | 473/582 |
| 8,506,431 | B2 | 8/2013 | Green et al. | |
| 2012/0270688 | A1 * | 10/2012 | Webber et al. | 473/582 |

* cited by examiner

*Primary Examiner* — John Ricci
(74) *Attorney, Agent, or Firm* — Jeremy A. Smith; Stephen H. Hall; Bradley Arant Boult Cummings LLP

(57) ABSTRACT

A modular, adjustable weight arrow tip is disclosed. The arrow tip has a body and one or more blades in various configurations. The arrow tip utilizes one more modular weights, preferably seated between the body rear end and the arrow shaft, to allow the user to be able to selectably adjust an incrementally stepped array of weights to achieve the desired flight and "front of center" for their application. The modular weights can be threaded or unthreaded, can utilize a modular weight seating collar, can have varying weights, and may be utilized with any type of archery tip.

19 Claims, 4 Drawing Sheets

MODULAR ADJUSTABLE WEIGHT ARROW TIP

FIELD OF THE DISCLOSURE

The present disclosure relates to the field of archery arrow tips and archery arrow shafts, and more particularly to a modular, adjustable weight arrow tip and shaft.

BACKGROUND

Target archers and archers who bowhunt utilize different arrow tips (or "points"), but both wish to modify and tune the arrow, arrow tips, arrow weight, and arrow "front of center" to achieve perfect arrow flight. Most arrow shafts have a threaded insert at one end and are designed to receive an arrow tip. Two commonly used arrow tips are field tips and broadheads. Target archers commonly use field tips, which often consist of a rounded or conical point similar in shape to a bullet, with a threaded portion that secures it to the arrow shaft via a threaded insert. Bowhunters commonly utilize broadheads for hunting, which will often have two or more blades. There are many different kinds of broadheads known in the industry, including fixed blade broadheads and mechanical broadheads. Some broadheads include 2 opposing blades, while others utilize three or more blades. Many broadheads use straight edged blades, while others are curved. Additional, specialized arrow tips exist for turkey hunting, rabbit hunting, and other small game, for example "judo" points. Most all arrow tips have a threaded portion (or "stud") adapted to be threaded into the threaded insert placed in the arrow shaft. This thread and insert system allows for archers and bowhunters to change arrow tips easily and quickly by merely unscrewing one tip and screwing in another.

Archers and bowhunters desire to control the aerodynamic properties and hunting properties of the arrow by selecting different weights of arrow tips. However, arrow tips with different weights, or even different shapes, will have different flight characteristics. For example, one field point may weigh 100 grains, while another field point may weigh 125 grains, and yet another may weigh 150 grains. All three different field points will have different flight characteristics.

Similarly, different broadhead arrow tips may have different weights, ranging from below 100 grains, to some specialty arrow tips weighing in at over 200 grains. The larger hunting arrow tips may be desired by a hunter for larger blades or more overall weight to produce more force upon impact.

At present, if an archer or bowhunter wishes to change the performance of their arrow via experimenting with different weighted arrow tips at the end of the arrow, they are generally required to purchase many different weighted field points or broadheads in order to test them and determine which performs best for the length of their arrow, spine of the arrow shaft and poundage of the bow they are shooting. Additionally, an archer may sight in their bow using field points that weigh 100 grains, but then later purchase broadheads or other hunting arrows tips that weigh 125 grains. In that instance, the archer may have to re-sight in their bow using 125 grain field points, or using the broadheads themselves.

Different arrows may have different spine flex, e.g., have different stiffness. In fact, a particular arrow manufacturer may have multiple arrow models/types having different spine flex, each different spine flex being optimized for different bows and different bow draw weights and lengths. If a weak arrow having too much flex is shot, it will have an undesirable amount of flex, and its flight trajectory may not be true. A stiffer arrow, on the other hand, will have less oscillation, or flex, when shot, will correct more quickly from the force of the bow, and have a better flight trajectory. Similarly, a shorter arrow will ordinarily have less spine flex than a longer arrow of the same type. However, having the right amount of weight at the front end of the arrow, for example, in the tip, can optimize the overall flex and trajectory. By adjusting the overall weight at the tip, a user can adjust how the spine reacts. Unfortunately, this normally requires the user to experiment with different tips, having different weights, to determine what works best for their bow, draw weight, draw length, arrow length, etc.

There are some prior art patents for arrow tips that incorporate limited aspect of adjustable weights, but such prior art patents are not user friendly, require specialized tools, and do not maximize the weight distribution and spine flex of the arrow shafts. Moreover, some of the prior art patents can even be dangerous to use. For example, U.S. Pat. No. 7,318,783 B2 discloses the use of one or more washers and weights to an arrow insert and arrow point in a location forward of the junction between the arrow shaft and the arrow tip, and located within a cavity formed by the broadhead blades. Adding weights to a threaded stub located between multiple sharp blades can obviously be dangerous. U.S. Pat. No. 5,269,534, discloses weights applied to the arrow shaft itself, behind the insert that accepts the arrow tip, and uses a horizontal bar to add and remove weights, actually adjusting the weight of the arrow, not the weight of the arrow tip. Special tools and/or systems are required to adjust the weights in these systems and they require extensive steps to accomplish change.

SUMMARY OF THE DISCLOSURE

The present invention will solve the archer's dilemma of weight distribution and spine flex of arrow shafts during flight and ultimately at the point of impact. The Modular Weight System (hereafter M.W.S.) will allow the individual archer to easily experiment with various front weights to enhance the flight of the arrow by adjusting the front load or "Front of Center" of the arrow. The M.W.S. is unique in that there is no known other system available that will allow such versatility and easy modification of the physics and physical characteristics of the arrow by adding or removing weights, particularly from the arrow shaft and arrow tip juncture. The M.W.S. will allow the archer to tune the flight of the arrow and spine characteristics of their arrow, preferably by inserting various modules, or modular weights, in between the end of the arrow shaft and the back of the arrow tip. The system has application to all arrows, crossbow bolts, bow fishing arrows, and the like, and associated tips, regardless of material, size or blade configuration. It can be used with all types of broadheads and hunting tips, including fixed blade and mechanical broadheads, field tips, etc.

Designed to allow the user to apply various weights, the M.W.S. allows the user to increase or decrease the weight of the arrow, and particularly at the arrow tip/arrow shaft junction, by adding or deducting weight modules. The user will be able to selectably adjust an incrementally stepped array of weights to achieve the desired flight and "front of center" for their application.

One object of the present invention is to provide a modular, adjustable weight arrow tip that is easy to use, and does not require special tools.

Another object of the invention is to provide an adjustable weight arrow tip that can be easily adjusted by adding or removing weights at the junction of the arrow tip and arrow shaft. These weights, or modules, can be used in conjunction with one another in a chain or stacking formation.

Another object of the invention is to provide an adjustable weight arrow tip that can optimize the overall flex and trajectory of an arrow.

BRIEF DESCRIPTION OF THE FIGURES

The present invention is disclosed with reference to the accompanying drawings, wherein.

Corresponding reference characters indicate corresponding parts throughout the several views. The examples set out herein illustrate several embodiments of the invention but should not be construed as limiting the scope of the invention in any manner.

DETAILED DESCRIPTION

Figure 1:
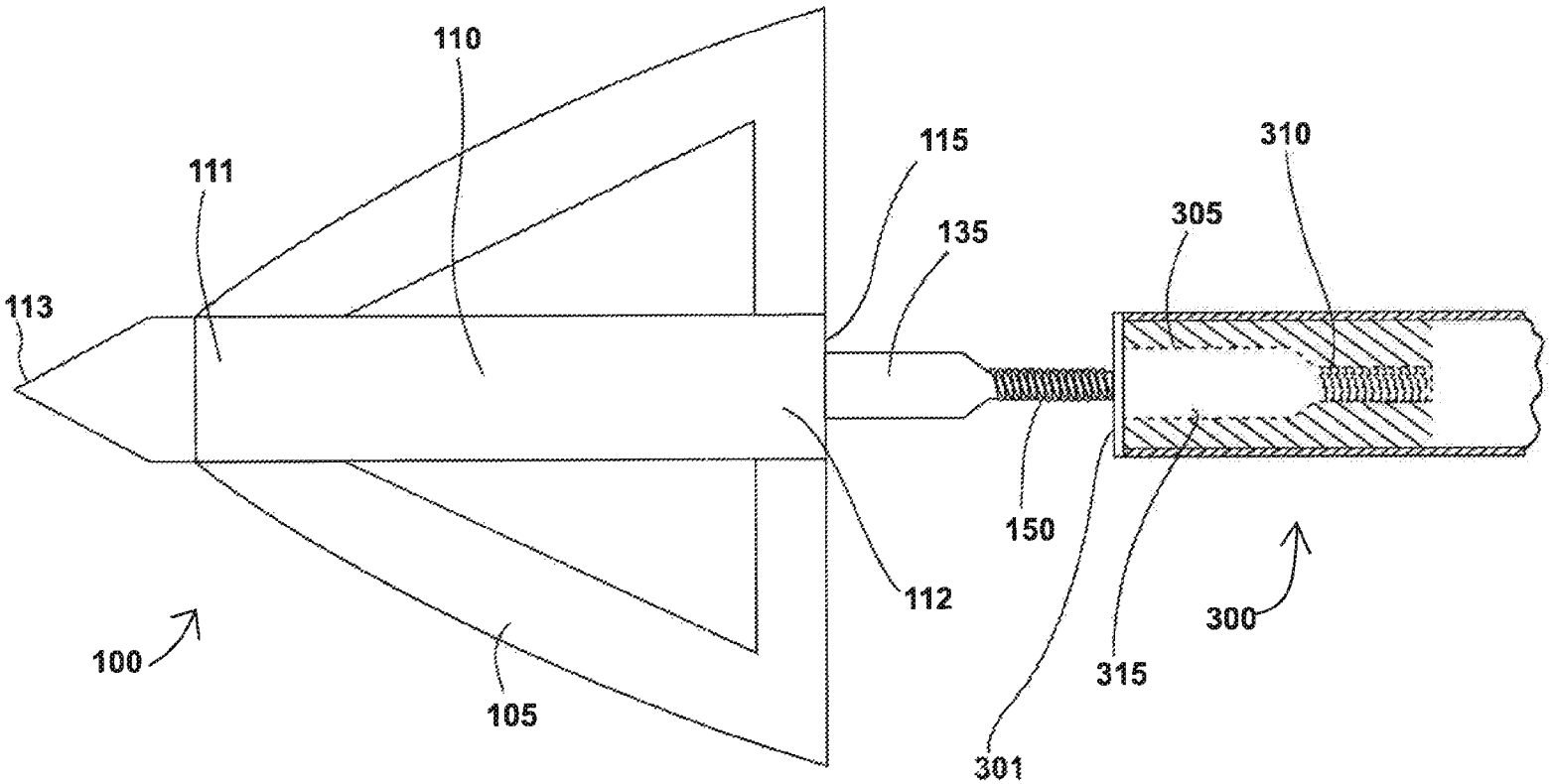
FIG. 1 is an side view of a prior art arrow tip, commonly referred to in this configuration as a broadhead.

For ease of reference, the following components and reference numbers are used:

100 Arrow tip
105 Blades
106 Set screw
110 Body
111 Body front end
112 Body rear end
113 Arrow tip point
115 Shoulder
120 Modular weight shoulder
130 Modular weight seating collar
135 Arrow seating neck
140 Modular weight seating collar shoulder
145 Height of the modular weight seating collar 130, designated as H0
150 Threaded stud
160 Outside diameter of modular weight main body OD1
165 Modular weight main body
170 Outside diameter of modular weight neck OD2
175 Modular weight neck
180 Outside diameter of modular weight channel OD3
190 Overall height of modular weight $H_1$
200 Height of modular weight without modular weight neck $H_2$
210 Height of modular weight neck $H_3$
300 Arrow
301 Arrow shaft opening
305 Arrow insert
310 Arrow insert threaded portion
315 Arrow insert unthreaded portion
320 Modular weight channel
500 Modular weight
510 Modular weight recessed portion As discussed above, existing broadheads come in many different sizes, shapes, and configurations, including fixed blade and mechanical, among others. There are a wide number of manufacturers and brands, often with their own specialized blade designs, including broadheads sold under the trademarks Toxic, Grim Reaper, Slick Trick, Muzzy, Wasp, Magnus, RamCat, NAP, Swhacker, Rocket, Carbon Express, G5, and Trophy Ridge, to name a few. These different broadhead designs are well known to those of skill in the art, the teachings of which incorporated herein by reference.

Referring to FIG. 1, an example prior art arrow tip 100 is depicted. In the configuration shown in FIG. 1, the particular arrow tip 100 is more commonly referred to as a broadhead. Other arrow tips that can include and utilize the present invention include field points, bowfishing arrow tips, crossbow bolts, and other related archery products. In its basic embodiment shown in FIG. 1, the arrow tip 100 contains a body 110, often cylindrical in nature, and a number of blades 105. The body 110 will normally have a front end 111 and a rear end 112. In FIG. 1, the front end 111 may have threaded arrow tip point 113 secured to the body 110, or integrally formed as part of the body 110. The body rear end 112 will often define a shoulder 115 that is designed to engage an arrow, and more particularly an arrow shaft, as described further below. The traditional broadhead will often have an arrow seating neck 135 and a threaded stud 150. The length of the arrow seating neck 135 and threaded stud 150 is generally approximately ¼ inches each (for a total of approximately ½ inches), and may range from ⅜ inches to ⅝ inches in combined length. In most prior art arrow tips 100, the length of the arrow seating neck 135 and threaded stud 150 are approximately equal.

Still referring to FIG. 1, the arrow tip 100 is configured to be inserted and secured to an arrow 300. The arrow 300 will traditionally have a nock and fletchings on the back end (not depicted), and an arrow shaft opening 301 on the front end to receive the arrow tip 100. The arrow 300 will normally have an arrow insert 305 placed inside the arrow shaft, and the arrow insert 305 will normally include a threaded portion 310 and a unthreaded portion 315 designed to receive the threaded stud 150 and arrow seating neck 135, respectively, of the arrow tip 100. The outer perimeter of the arrow opening 301 rests against the arrow tip shoulder 115 when the threaded stud 150 is screwed into the threaded portion 310 of the arrow insert 305. Preferably, the body 110 is circular in cross section and has the same outer diameter at the body rear end 112 as the outer diameter of the arrow 300. This provides better aerodynamic properties.

Figure 2:
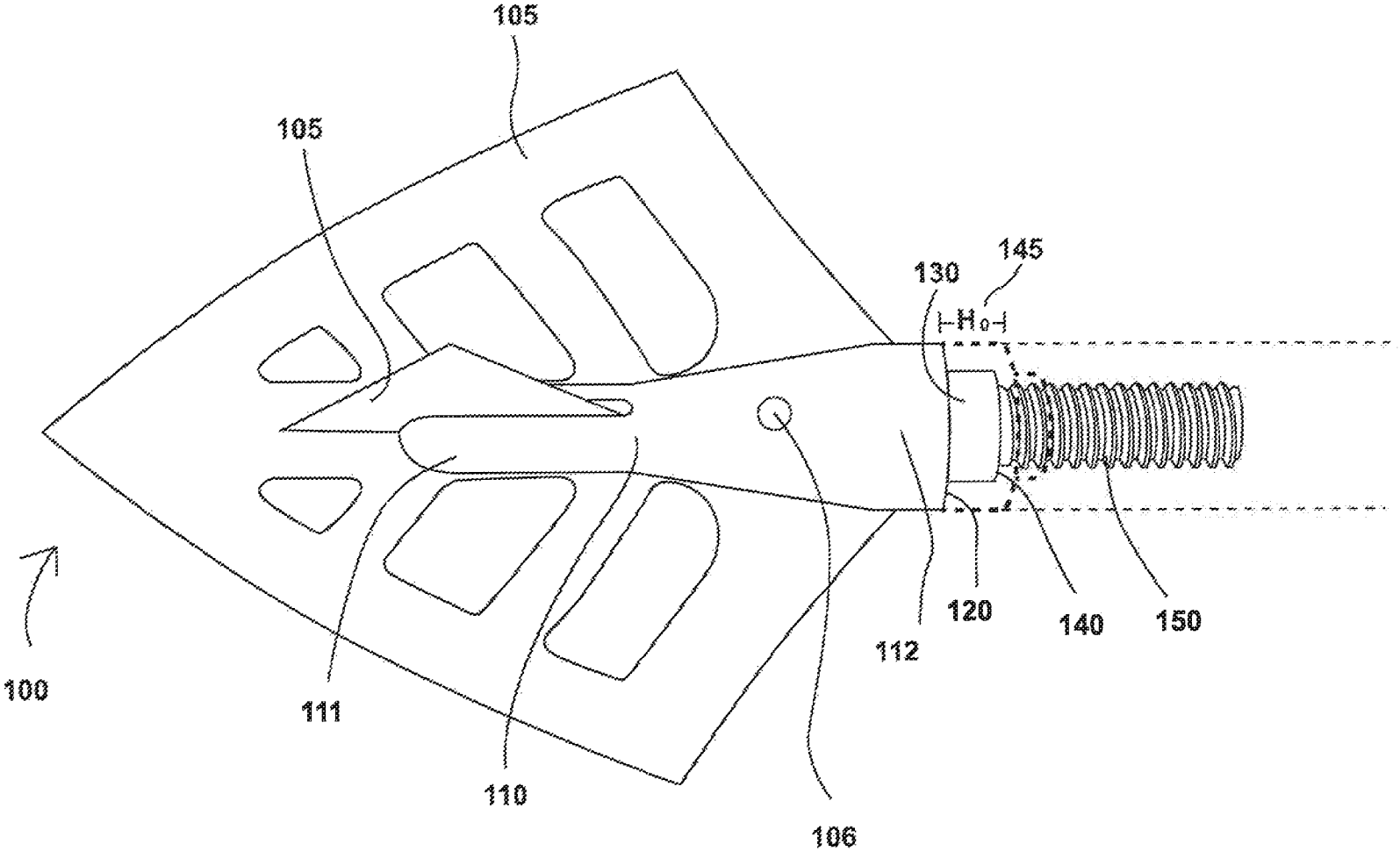
FIG. 2 is a perspective view of one embodiment of the present invention.

Depicted in FIG. 2 (not to scale) is one embodiment of the current invention. FIG. 2 discloses an arrow tip 100 having blades 105 and a body 110. One or more of the blades may be secured to the body 110 using a set screw 106 that can go through the body 110 and one or more of the blades 105. In this embodiment, the body 110 is circular in cross section, but has a varying diameter, from a smaller cross section toward the body front end 111 transitioning to a larger cross section toward the body back end 112. The blades may be in any configuration, material, size, or shape known to those of skill in the art as discussed above. The blades 105 can be forward of the body front end 111, as shown FIG. 2, or body front end 111 may have a separate sharpened point, with the blades behind the arrow tip point 113, as shown in FIG. 1. In this second configuration, the arrow tip point 113 may be removable, often through a threaded connection, as in commonly known in the art. The blades 105 of the arrow tip 100 may be in a stand-alone, "fixed" configuration, e.g., the blades are secured in place even without being attached to an arrow. The blades 105 can be secured to the body using any means known in the industry, including by a set screw discussed below, a threaded arrow tip point 113 (as shown in FIG. 1), collar on the trailing edge of the blades, or formed integrally with the body (e.g., not designed to be removable from the body). Alternatively, the blades 105 may only be "fixed" when the arrow tip 100 is screwed into the arrow (in this latter case, the compression against the arrow tip 100 securing the blades 105 in place). In a preferred embodiment, the body 110 is made of aluminum, and more preferably 7075 aircraft grade aluminum. Other acceptable materials known to those of skill in the art, and utilized in other existing arrow tips can be utilized, including steel and stainless steel.

Although many different blade configurations can be utilized, including any of the many blade configurations from the various manufacturers and brands discussed above, the arrow tip 100 in FIG. 2 utilizes a main blade having a 1.21 inch cutting surface, and a "bleeder blade" having a 0.63 inch cutting surface, and generally in a perpendicular arrangement to the main blade. As discussed above, almost any blade configuration can be utilized, provided that appropriate changes are made to the arrow tip 100 to accommodate the modular weight discussed further below.

Referring to the configuration shown in FIG. 2, the arrow tip 100 includes a modular weight shoulder 120 at the body rear end 112. The modular weight shoulder 120 is preferably circular in cross section, forming a planar section which is perpendicular to the longitudinal axis of the body 110. The modular weight shoulder 120 is configured to rest against a modular weight 500, if used, or against the arrow shaft opening 301, if the modular weight 500 is not used. The outer diameter of the body 110 at the rear end 112 is preferably the same as the modular weight outer diameter 160 and the outer diameter of the arrow 300. In one embodiment, the outer diameter of the body at the rear end 112 is between ¼ inches and ½ inches, although the size can vary. In a preferred embodiment, it has an outside diameter of approximately 5/16 inches.

Still referring to the embodiment of FIG. 2, the body rear end 112 may contain a modular weight seating collar 130. In one embodiment the modular weight seating collar is circular in cross section, forming a planar section which is perpendicular to the longitudinal axis of the body 110 and threaded stud 150, and parallel to the planar section of the modular weight shoulder 120. At the trailing end of the modular weight seating collar 130 is a modular weight seating collar shoulder 140, from which the threaded stud 150 extends, preferably along the same longitudinal axis of the body 110. In one embodiment, the modular weight seating collar 130 is between ⅛ inches and ¾ inches in diameter. In a preferred embodiment, the modular weight seating collar 130 is approximately 5/16 inches in diameter. The diameter of the modular weight seating collar 130 may correspond to, or at least approximate, the outside diameter of the modular weight neck 170, discussed further below. The modular weight seating collar 130 can be threaded or unthreaded. In a preferred embodiment, it is unthreaded. In a separate embodiment, the modular weight seating collar 130 can be the same approximate diameter as the threaded stud 150, but be unthreaded, such that there is a single extension from the body rear end 112 (e.g., a single stud which is partially unthreaded toward the body rear end 112, and partially threaded to be secured into the arrow insert threaded portion 310.

In one embodiment, the height of the modular weight seating collar 130, designated as H0 145, is between 1/16 inches and ¾ inches. Similarly, the threaded stud 150 may be between 1/16 inches and ¼ inches in diameter and between ¼ inches and 1.5 inches long. In a preferred embodiment, the threaded stud has a diameter of approximately 3/16 inches and a length of ⅝ inches. The diameter and length can be varied as necessary and desired. Unlike most conventional broadheads where there is approximately ½ unthreaded portion (arrow seating neck 135 of FIG. 1) and a ½ threaded portion (threaded stud 150 of FIG. 1) that extends into the arrow shaft insert 305, one embodiment of the current invention has a ratio of unthreaded portion (the modular weigh seating collar 130) to threaded portion (threaded stud 150) of between 1:3 and 1:5 (e.g., for every ¼ inch of unthreaded portion, there is ¾ inches to 1¼ inches of threaded stud 150). Unlike the conventional broadheads, the current invention can contain very little or no unthreaded portions. The extra length of the threaded stud 150 can accommodate one or more modular weights 500.

In alternative embodiments (not depicted), a modular weight seating collar 130 is not utilized and the threaded stud 150 is connected directly to the modular weight shoulder 120. The modular weight 500 is depicted in dashed lines in FIG. 2. As can be seen in FIG. 2, additional portions of the threaded stud 150 remain that can be secured in the arrow shaft insert 305.

Figure 3B:
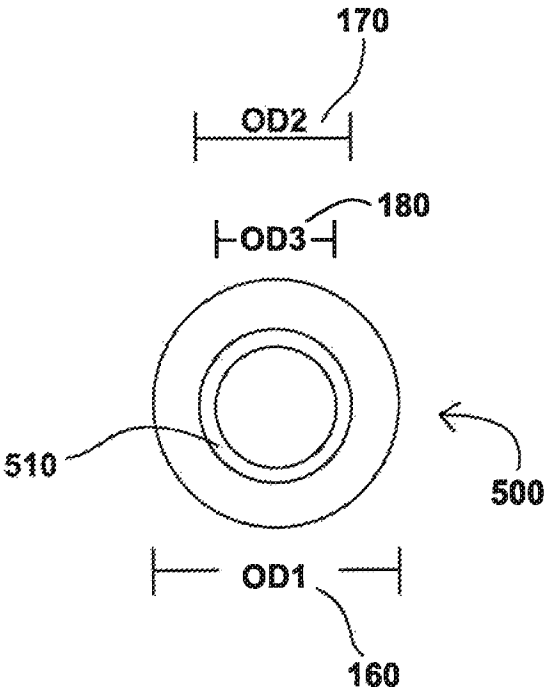
FIG. 3B is a top view of one embodiment of the modular adjustable weight.
Figure 3A:
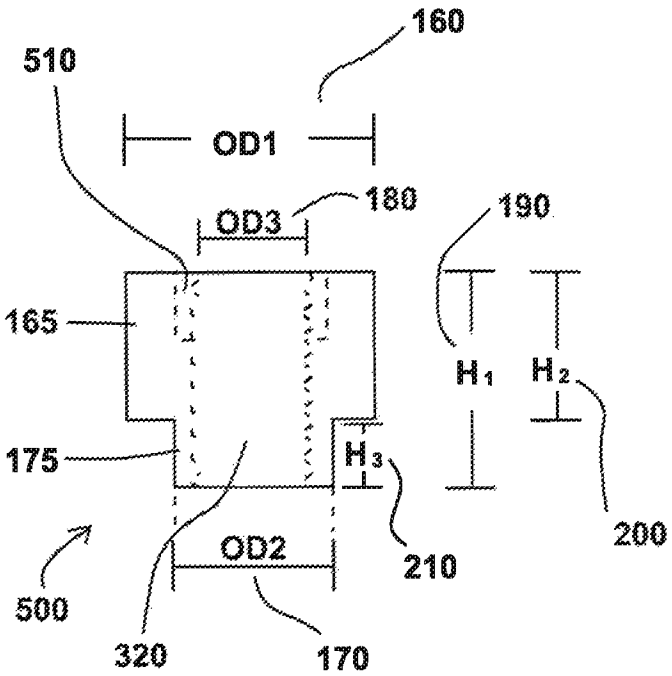
FIG. 3A is a side view of one embodiment of the modular adjustable weight.

Depicted in FIG. 3A is a side view of one embodiment of the modular weight 500. In this embodiment, the modular weight has a main body 165, having an outside diameter designated as OD1 160, and a neck 175, having an outside diameter of OD2 170. In one embodiment, the modular weight 500 has a main body outside diameter 160 of between ¼ inches and ½ inches, although the size can vary. In a preferred embodiment, it has a main body outside diameter 160 of approximately 5/16 inches. In one embodiment, the modular weight neck 175 has an outside diameter 170 of between 1/16 inches and ¼ inches, although the size can vary. In a preferred embodiment, the modular weight neck 175 had an outside diameter 170 of approximately 3/16 inches.

In one embodiment, the overall height of the modular weight 500, having a height designated at H1 190, is between ⅛ inches and ½ inches, although the size can vary. In a preferred embodiment, the overall height of the modular weight 190, is approximately 5/16 inches. In one embodiment, the height of the main body of the modular weight, designated as H2 200, is between 1/16 inches and ½ inches, although the size can vary. In the preferred embodiment, the height of the main body of the modular weight 200 is 3/16 inches. In one embodiment, the height of the modular weight neck, designated as H3 210, is between 1/16 inches and ½ inches. In the preferred embodiment, the height of the modular weight neck 210 is approximately ⅛ inches.

The modular weight 500 has a channel 320 through which the threaded stud 150 may placed. The outer diameter of the channel 320, designated as OD3 180, in FIGS. 3A and 3B, may correspond to, or approximate, the diameter of the threaded stud 150. In one embodiment, the outer diameter of the channel 180 is between 1/16 inches and ¼ inches. In a preferred embodiment, the outer diameter of the channel 180 is approximately ⅛ inches. The modular weight channel 320 can be threaded or unthreaded. In the threaded embodiment, it is secured to the arrow tip 100 by screwing it on the threaded stud 150, and preferably seated against the modular weight shoulder 120. The modular weights 500 can be of various size and configuration, and may not utilize the neck depicted in FIG. 3A. For example, they can be of uniform cross section. The modular weights 500 may have different heights to accommodate different weights. Preferably the modular weight 500 is of circular cross section.

In another embodiment, the modular weight channel 320 of the modular weight 500 is not threaded. In this embodiment, the modular weight 500 can be secured between the modular weight shoulder 120 and the arrow 300 by compression fit using the threaded stud 150 in the threaded arrow insert threaded portion 310.

In the embodiment of the arrow tip 100 using a modular weight seating collar 130, the modular weight 500 can have a recessed portion 510 that corresponds to the size, shape, and configuration of the modular weight seating collar 130 such that the modular weight 500 can be secured such that there is no gap between the modular weight shoulder 120 and the forward facing portion of the modular weight 500. The modular weight neck outside diameter 170 may also correspond to the outside diameter of the modular weight seating collar 130 as well as the modular weight recessed portion 510. Similarly, the depth of the modular weight recessed portion 510 may correspond to the height of the modular weight neck 210. This is helpful when multiple modular weights are used together. In this instance, the modular weight neck 175 of the first modular weight 500 is seated in the modular weight recessed portion 510 of the second modular weight 500.

In one embodiment, the modular weight 500 is between about 10 and 100 grains in weight, although the modular weight can be of almost any weight. In one embodiment, the modular weight is made of stainless steel. In other embodiments, the modular weight is made of steel, aluminum, brass, or copper.

Figure 4:
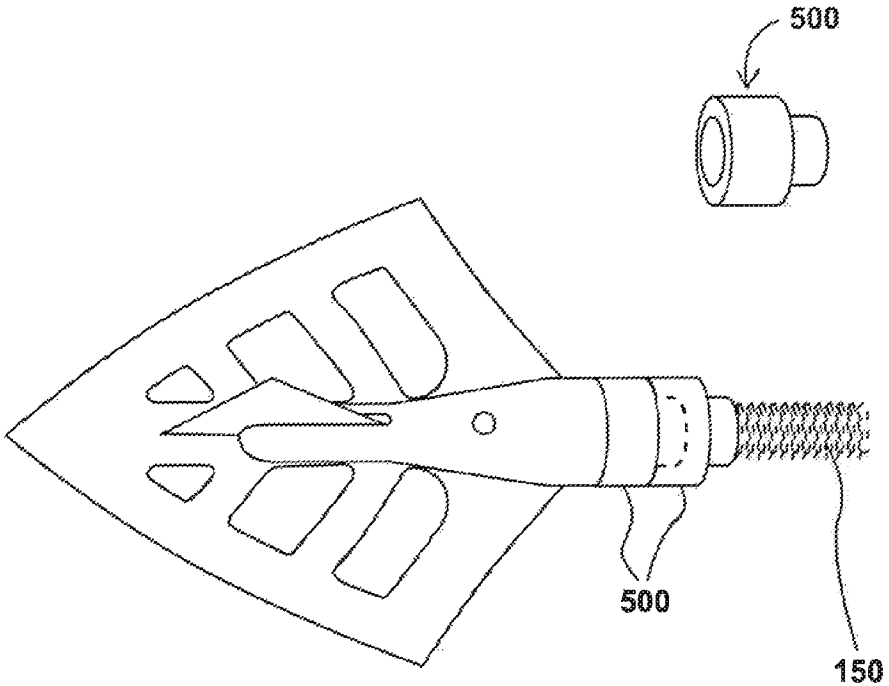
FIG. 4 is a view of one embodiment having two modular adjustable weights stacked or "chained" together.

Depicted in FIG. 4 is one embodiment of the invention of several modular adjustable weights stacked or "chained" together. This allows a user to customize the amount of weight. The extra length of the threaded stud 150 can help allow a threaded portion to remain available for securing to the arrow shaft insert 305, despite a portion of the threaded stud 150 covered by the extra modular weights 500. When used with an arrow, the threaded stud 150 is screwed into the arrow insert 305, or otherwise fixed to the arrow shaft by means known to those of skill in the art. In the preferred embodiment the arrow shaft opening 301 rests against the trailing edge of the modular weight body 165. In embodiments using a modular weight neck 175, the neck preferably rests in the arrow insert unthreaded portion 315.

In an alternative embodiment, the modular weight 500 does not have the same outside diameter as the arrow 300 and/or the rear end of arrow tip body 112. The modular weight 500 can be made of metals, plastics, rubbers, synthetic materials, and liquids in various sizes, shapes and weights. The modular weight(s) 500 preferably reside in the junction between the arrow shaft and the body rear end 112 by means of tap and die threads, compression fit, adhesives and other means of affixing the weight to allow interchangeability and modular use. These modular weight(s) 500 can be used in conjunction with one another in a chain or stacking formation.

The total weight of the arrow tip 100, including the body 110, blades 105, modular weight seating collar 130 (if used), and threaded stud 150 can vary based on the size and diameter of the body, blades used, blade configurations, etc. In one embodiment, the arrow tip 100 is 100 grains. In alternative embodiments, the arrow tip 100 is 125 grains, and in a third embodiment, the arrow tip is 150 grains. Obviously, the arrow tip 100 can be designed to any desired weight. The modular weight 500 can also be of various weights based on the size and diameter of the body and/or arrow 300 shaft, based on the materials used to construct the modular weight 500, or the overall height of the modular weight. In one embodiment, the modular weight 500 is 25 grains. In alternative embodiments, the modular weight 500 is 10 grains, and in a third embodiment, the modular weight 500 is 50 grains. In another embodiment, multiple modular weights 500 of varying weights are provided such that any desired overall weight can be achieved. This allows a user to easily use and test various weight combinations with the user's particular configuration. For example, if the "base" arrow tip 100 weighs 100 grains, but the user has determined that a total weight of 125 grains provides the optimum "front of center" for the user's particular arrow and bow configuration, the user can simply add a 25 grain modular weight 500 to obtain the desired weight distribution.

The modular weight 500 can also be sold separate from an arrow tip 100, and designed to be utilized with any of the various existing arrow tip designs. Moreover, the modular weight 500 could be configured to be secured into the arrow shaft (rather than to an arrow tip), for example, by having its own threaded portion and/or neck designed to engage the standard arrow insert 305 depicted in FIG. 1. In this embodiment, the modular weight channel 320 could be configured to receive the threaded stud 150 of an arrow tip 100.

The modular weight 500 can also be configured to have a recessed portion on the trailing end that is sized to create a sleeve that goes on the outside of the arrow shaft when in use. Thus the front end of the modular weight 500 rests against the modular weight shoulder 120, while the trailing end forms a sleeve that slides over the outer diameter of the arrow shaft. This embodiment can provide so additional structural rigidity to the front of the arrow.

The modular weight 500 can also incorporate small blades, spurs, or protrusions that extend out from its surface. This can provide additional cutting surfaces, help the arrow not pass through a target, and/or provide more force on impact. In such embodiment, the blades, spurs, or protrusions are preferably offset from the main blades and/or bleeder blades, to provide additional cutting surfaces.

Although particular embodiments of the present disclosure have been described, it is not intended that such references be construed as limitations upon the scope of this disclosure except as set forth in the claims.

I claim:

1. An adjustable weight arrow tip comprising:

a body having an axis, a front end and a rear end, where the rear end is circular in cross section and defines a modular weight shoulder;

an unthreaded modular weight seating collar attached to the body rear end, where the modular weight seating collar is circular in cross section and defines a modular weight seating collar shoulder;

a threaded stud extending from the modular weight seating collar along the same axis as the body; and a modular weight comprising a modular weight body; and modular weight neck, where the modular weight body and modular weight neck have a threaded channel configured to correspond to, and receive, the threaded stud, and where the modular weight body has a recessed portion configured to correspond to, and receive, the modular weight seating collar, and where the modular weight is secured against the modular weight shoulder.

2. The arrow tip of claim 1 where the modular weight is between 10 and 100 grains.

3. The arrow tip of claim 2 where the modular weight is made of stainless steel.

4. The arrow tip of claim 1 where the modular weight body has a circular cross section having a diameter that corresponds to the diameter of the rear end of the arrow tip body.

5. The arrow tip of claim 1 where the outside diameter of the modular weight neck corresponds to the diameter of the modular weight seating collar.

6. The arrow tip of claim 4 having two main blades and two bleeder blades in perpendicular arrangement to the two main blades.

7. The arrow tip of claim 1 where the modular weight seating collar has a height of between 1/16 and 3/4 inches and the threaded stud is between 1/2 inches and 1 inch long.

8. An arrow tip comprising:

a body having an axis, a front end and a back end;

a modular weight seating collar formed at the trailing edge of the body back end defining a modular weight shoulder;

a threaded stud having a diameter extending from the modular weight seating collar along the same axis of the body; and a modular weight having a main body and a channel, the main body have a recessed portion sized to correspond to the modular weight seating collar such that the modular weight rests against the modular weight shoulder, and the channel sized to be the same diameter or larger than the diameter of the threaded stud and wherein the channel is threaded and configured to correspond to, and receive, the threaded stud.

9. The arrow tip of claim 8 where the modular weight further comprises a neck having a diameter that corresponds to the diameter of the modular weight seating collar.

10. The arrow tip of claim 9 where the neck has a height between 1/16 and 1/2 inches.

11. The arrow tip of claim 8 where the modular weight body has an outside diameter that corresponds to the outside diameter of the rear end of the arrow tip body.

12. The arrow tip of claim 8 where the overall height of the modular weight is between 1/8 and 1/2 inches, and weighs between 10 and 50 grains.

13. An arrow tip comprising:

a body having a front end and a back end and one or more blades, the back end defining a shoulder;

a threaded stud extending from the back end of the body configured to correspond to an arrow insert threaded portion;

a modular weight comprising a modular weight body; and modular weight neck, where the modular weight body and modular weight neck have a threaded channel configured to correspond to, and receive, the threaded stud, and where the modular weight is secured against the modular weight shoulder.

14. The arrow tip of claim 13 where the modular weight is between 10 and 50 grains.

15. The arrow tip of claim 13 where the modular weight body has an outside diameter that corresponds to the outside diameter of the rear end of the arrow tip body.

16. The arrow tip of claim 13 where the modular weight is made of stainless steel.

17. The arrow tip of claim 13 where the overall height of the modular weight is between 1/8 and 1/2 inches.

18. The arrow tip of claim 13 where the neck has a height between 1/16 and 1/2 inches.

19. The arrow tip of claim 13 having two or more modular weights.

* * * * *